US006896580B2

(12) United States Patent
Falla et al.

(10) Patent No.: US 6,896,580 B2
(45) Date of Patent: May 24, 2005

(54) PROTECTED UNDERWIRE

(75) Inventors: Gloria Falla, Demarest, NJ (US); Deborah Batcha, New York, NY (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/742,571

(22) Filed: Dec. 19, 2003

(65) Prior Publication Data

US 2004/0192165 A1 Sep. 30, 2004

Related U.S. Application Data

(63) Continuation-in-part of application No. 10/313,992, filed on Dec. 6, 2002, now Pat. No. 6,682,395.

(51) Int. Cl.[7] ..... A41C 3/00
(52) U.S. Cl. ..... 450/41; 450/42; 2/255
(58) Field of Search ..... 450/41, 42, 45–51, 450/53; 2/255–260, 260.1, 261, 264

(56) References Cited

U.S. PATENT DOCUMENTS

| | | | | |
|---|---|---|---|---|
| 2,900,982 | A | 8/1959 | Lopez-Henriquez | |
| 3,114,374 | A | 12/1963 | Chalfin et al. | |
| 3,562,802 | A | 2/1971 | Avis | |
| 3,605,753 | A | 9/1971 | Schwartz | |
| 3,726,286 | A | 4/1973 | Wolfson | |
| 3,964,491 | A | 6/1976 | Martini | |
| 4,203,449 | A | 5/1980 | Winzelberg | |
| 5,215,494 | A | 6/1993 | Flanagan | |
| 5,669,247 | A | 9/1997 | McCartney et al. | |
| 5,730,640 | A | 3/1998 | Acx et al. | |
| 6,053,800 | A | 4/2000 | Lattanzi | |
| 6,190,232 | B1 | 2/2001 | Boser | |
| 6,435,939 | B1 | 8/2002 | Lin | |
| 6,682,395 | B2 * | 1/2004 | Falla et al. | 450/41 |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

In a first embodiment, a first fabric layer has gelatinous strips, thereby separating the first fabric layer into sections. A second fabric layer is positioned upon the first fabric layer, and an underwire is positioned on the second fabric layer opposite the first fabric layer. The first fabric layer is then folded onto itself to enclose the second fabric layer and the underwire. In a second embodiment, a third, or intermediate, fabric layer is positioned between the first and second fabric layers. In a third embodiment, an underwire is surrounded by a first, non-woven fabric layer. A second, rigid-type fabric having a bladder with a gelatinous material is positioned on the first fabric. The first fabric is wrapped around the underwire, and the bladder is positioned against the body of the wearer.

19 Claims, 7 Drawing Sheets

PROTECTED UNDERWIRE

RELATED APPLICATIONS

This application is a continuation-in-part of U.S. application Ser. No. 10/313,992 filed Dec. 6, 2002, now U.S. Pat. No. 6,682,395.

BACKGROUND OF THE INVENTION

1. Field of the Invention

The present invention relates to brassieres. More particularly, the present invention relates to a protected brassiere underwire and method of making the same.

2. Description of the Related Art

The use of underwire elements, especially U-shaped underwires, for shaping and supporting the lower periphery of brassiere or bra cups has long been known in the art. The term "underwire" has been in common use to refer to such elements. An underwire includes metal wires, coated metal wires, as well as wire elements made of many different materials, such as plastic or other polymeric materials. These underwires must be rigid enough, particularly in the plane of the brassiere, to provide adequate support for the bust and yet flexible enough to conform easily to the wearer's body for comfort and appearance. Such underwires are provided in a variety of shapes and configurations and must satisfy a number of requirements. For example, the underwire must not poke through the fabric to cause damage to the clothing of the wearer, and possibly injury to the wearer. It also must be readily insertable. Commonly, such underwires have been inserted into fabric sleeves disposed about the lower periphery of the bra cups.

Modern underwires are generally formed of relatively thin lengths of metal or polymeric material having a rectangular or rounded cross-section. A fairly stiff length of such material is shaped into a generalized U-shape and positioned in a sleeve disposed about the lower periphery of each bra cup. These stiff metal underwires are sometimes coated with various polymeric materials and often have plastic or enamel tips disposed at each end of the underwire.

While underwires have achieved widespread usage, certain disadvantages result from their use. These disadvantages relate to the relative stiffness, and therefore discomfort of these conventional underwires, and to the uniformity of that stiffness and, thus, the lack of adaptability to the needs of various users.

In light of the foregoing, there is an ongoing need for underwires or underwire structures, that are comfortable to wear, resilient, and adequately support the breasts of the wearer.

SUMMARY OF THE INVENTION

It is an object of the present invention to provide a cushion feel underwire or underwire structure.

It is an another object of the present invention to provide such an underwire structure that has a greater cushioning ability or greater "loft" than the underwire structures of the prior art.

It is still another object of the present invention to provide such an underwire structure that avoids having a thick appearance and/or a stiff feel.

It is yet another object of the present invention to provide such an underwire structure that can be used in a number of different sized brassieres.

It is a further object of the present invention to provide such an underwire structure that is particularly comfortable to wear, and can be conveniently assembled in the brassiere.

It is still a further object of the present invention to provide such an underwire structure that has its own casing.

These and other objects and advantages of the present invention are achieved by the underwire structure of the present invention. In a first embodiment, there are provided two or more outer fabric layers. The outer fabric layers each have gelatinous strips associated therewith. The gelatinous strips separate the outer fabric layers into sections. An inner fabric layer is positioned upon the gelatinous strips of the first outer fabric layer. This inner fabric layer is preferably non-woven. An underwire is positioned on the inner fabric layer opposite the outer fabric layer. The outer fabric layers are then folded to enclose the gelatinous strips, the inner fabric layer and the underwire. Thus, the underwire is enclosed in a casing formed by the outer fabric layers. Once the outer fabric layers are folded, a fold line is created.

In a second embodiment, there is provided four fabric layers and an underwire. As in the first embodiment, the first and second outer fabric layers each have at least one surface with gelatinous strips, thereby separating the surface and/or outer fabric layer into sections. The second outer fabric layer forms an outside covering for the underwire. As in the first embodiment, an inner fabric layer is positioned on the underwire to form an inside covering for the underwire. The inner fabric layer is preferably non-woven. An intermediate fabric layer is positioned between the first outer and inner fabric layers to form a second interior covering for the underwire. The underwire is positioned on the inner fabric layer opposite the intermediate fabric layer. The second and first outer fabric layers are folded to enclose the inner and intermediate fabric layers and the underwire. Thus, the underwire is encased by all four fabric layers. In this second embodiment, a fold line is knitted into the second outer fabric layer and first outer fabric layer prior to folding.

In a third embodiment, there is also provided an underwire. The underwire is surrounded by a non-woven fabric layer. A bladder containing a gelatinous material is encased by a rigid-type fabric. The bladder is positioned on the non-woven fabric layer opposite the underwire. The purpose of the non-woven fabric is to reduce the risk of the underwire poking through the rigid fabric encasing the bladder. The bladder is preformed or pre-made into a preshaped configuration. The fabric encasing the bladder is preferably a rigid fabric. More preferably, the fabric encasing the bladder is a tricot or warp knit fabric. The non-woven fabric is wrapped around the underwire, and the bladder is positioned against the body fabric that forms the breast cup of the brassiere.

In all embodiments, the non-woven fabric layer may also be made of a stretchable material.

BRIEF DESCRIPTION OF THE DRAWINGS

The objects and advantages of the present invention will be more apparent from the following detailed description of the present invention, in conjunction with the accompanying drawings wherein.

DETAILED DESCRIPTION OF THE INVENTION

Figure 1:
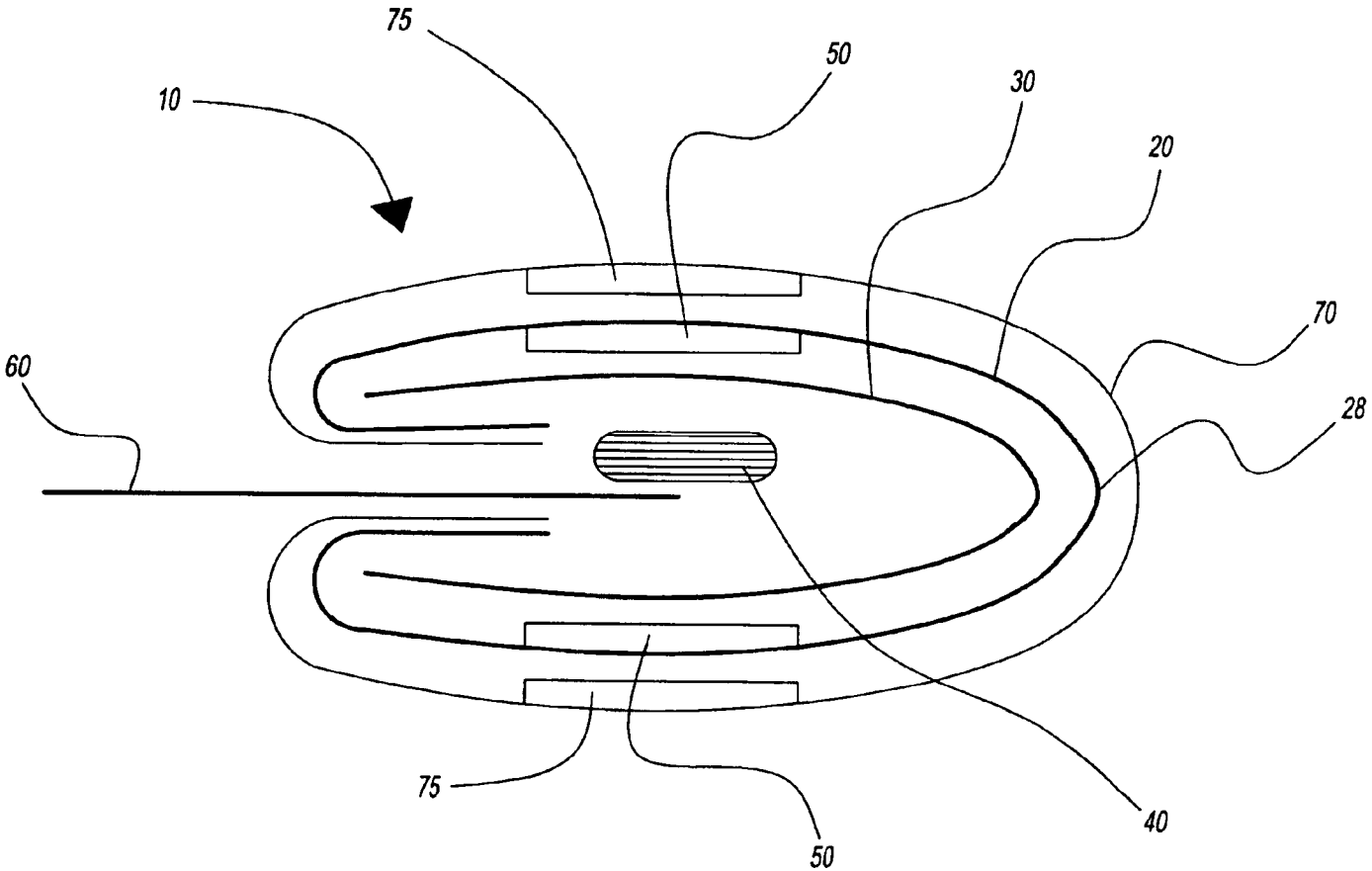
FIG. 1 is a schematic drawing showing a first embodiment of the present invention.

Referring to the drawings, and in particular, FIG. 1, there is provided a first embodiment of an underwire structure of the present invention generally represented by reference numeral 10. Underwire structure 10 has a first outer layer of material 20 upon which a first gelatinous material 50 is applied. Underwire structure 10 also has a second outer layer of material 70 upon which a second gelatinous material 75 is applied. It should be noted that, while first and second outer material layers are preferred, multiple layers may be employed to provide enhanced cushioning effect. Gelatinous materials 50 and 75 are preferably applied in one or more strips to first outer material layer 20 and second outer material layer 70. However, it should be noted that gelatinous materials 50 and 75 may be applied in any manner known in the art. Non-limiting examples include sinusodial, dashed or dotted patterns. An inner layer of material 30 is positioned adjacent to gelatinous material 50 on first outer material layer 20, and an underwire 40 is positioned on or adjacent to inner material layer 30 opposite first outer material layer 20.

Figure 2:
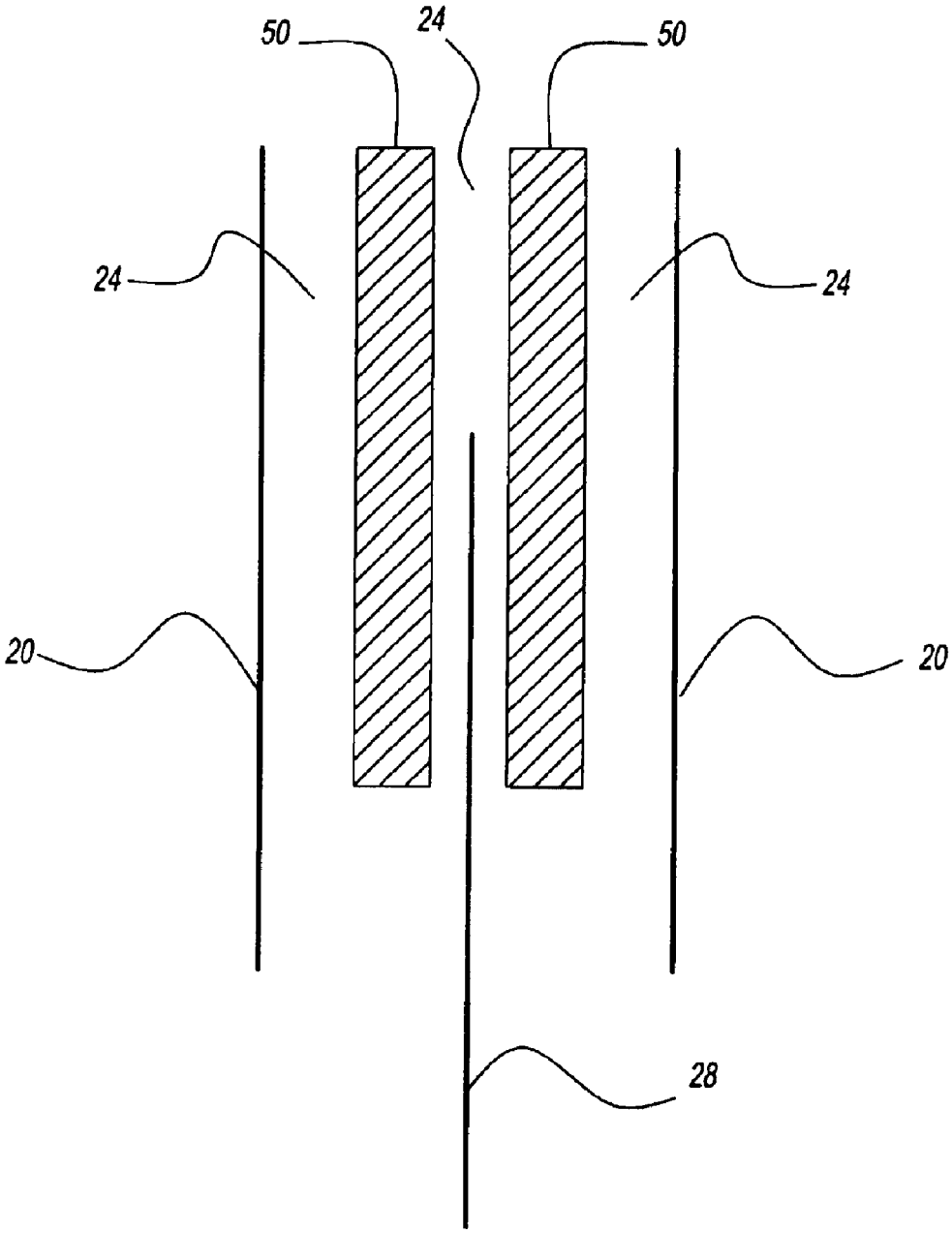
FIG. 2 is a magnified view of the stretch fabric used for any of the outer layers in the first embodiment of the present invention.

As shown in FIG. 2, outer material layers 20 and 70 (outer layer 20 represented) preferably have two strips of gelatinous material 50 placed thereon. Accordingly, the outer material layers preferably have three regions that are not covered by gelatinous material 50. These three regions are two sew regions or edges 24, and a fold line or third sew region 28. Fold line 28 is located along the center of outer material layer 20.

Referring again to FIG. 1, second outer material layer 70 with gelatinous material 75 is adjacent to first outer material layer 20 with gelatinous material 50. First outer material layer 20 with gelatinous material 50 is also adjacent to inner material layer 30 with one side of inner material layer 30 contacting gelatinous material 50. Second outer material layer 70, gelatinous material 75, first outer material layer 20, gelatinous material 50 and inner material layer 30 are wrapped around underwire 40. A body fabric 60 is positioned on a side of underwire 40 opposite inner material layer 30. Second outer material layer 70 with gelatinous material 75 and first outer material layer 20 with gelatinous material 50 provide a cushioned feel and loft about underwire 40 thereby making the underwire structure more comfortable for the wearer. Inner material layer 30 prevents underwire 40 from poking through outer material layer 20.

During assembly, second outer material layer 70 and first outer material layer 20 are positioned adjacent to one another. Inner material layer 30 is positioned adjacent to gelatinous material 50 of outer material layer 20. Underwire 40 is positioned on or adjacent to inner material layer 30 opposite outer material layer 20. Body fabric 60 is positioned on one side of underwire 40 opposite inner material layer 30. Preferably, a portion of body fabric 60 is positioned on one side of underwire 40 such that body fabric 60 is in the same plane as underwire 40. Second outer material layer 70 and first outer material layer 20 are then folded about fold line 28 to enclose gelatinous material 75, gelatinous material 50, and inner material layer 30 about the end of body fabric 60 and underwire 40. When outer material layer 20 and inner material layer 30 are folded along fold line 28, a channel is created for underwire 40. Thus, in this embodiment, a casing for underwire 40 is formed by second outer material layer 70, gelatinous material 75, first outer material layer 20, gelatinous material 50 and inner material layer 30. In the first embodiment shown in FIG. 1, the underwire casing is sealed using single needle stitching.

Figure 3:
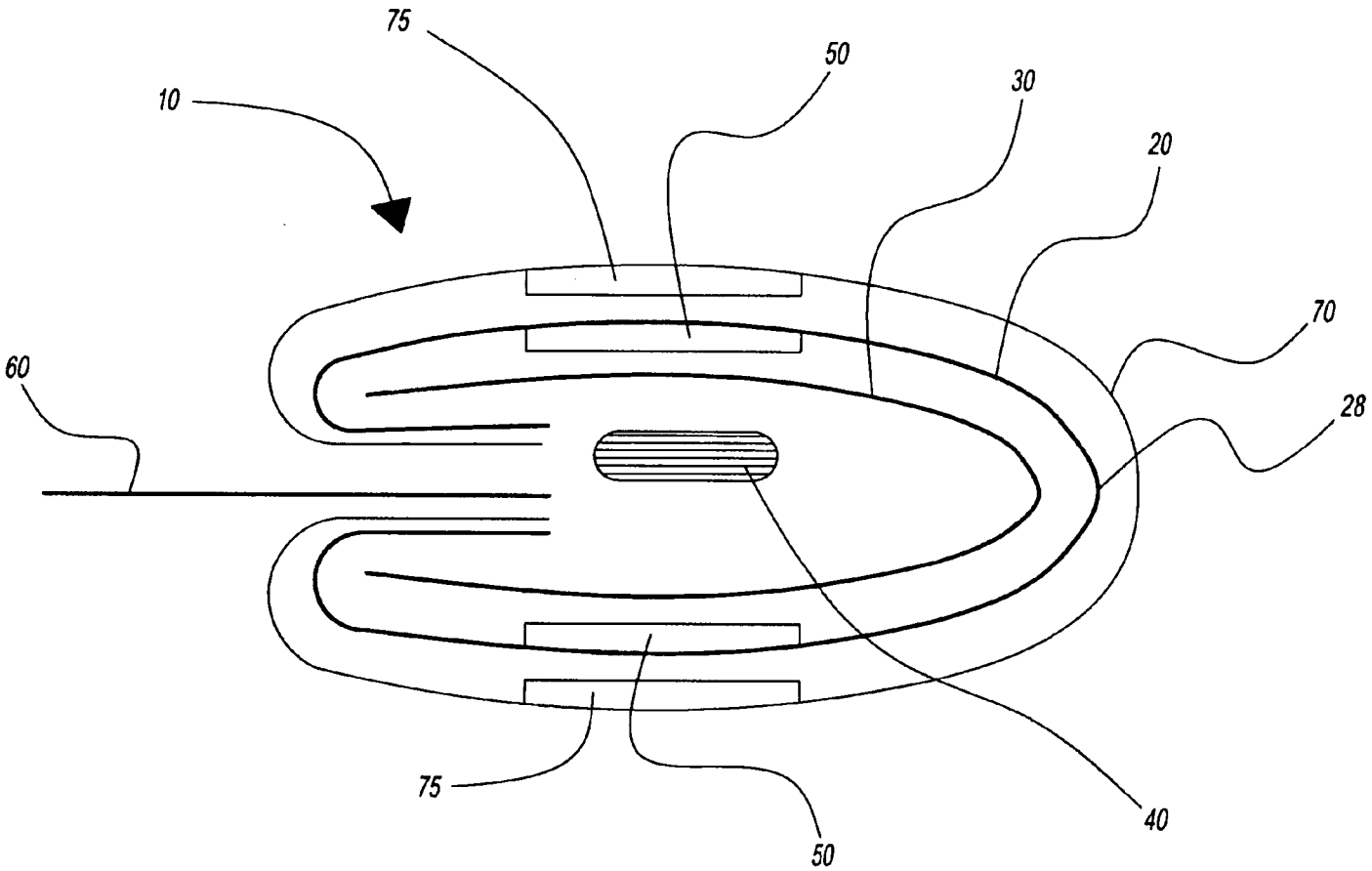
FIG. 3 is a schematic drawing showing an alternative to the first embodiment of the present invention.

Body fabric 60 may be positioned in alternative locations in relation to underwire structure 10. Referring to FIG. 3, body fabric 60 may be positioned such that it is not in the same plane as underwire 40. Instead, when second outer material layer 70 and first outer material layer 20 are folded, body fabric 60 is sandwiched directly between the ends of second outer fabric layer 70 and does not come into contact with underwire 40.

Figure 4:
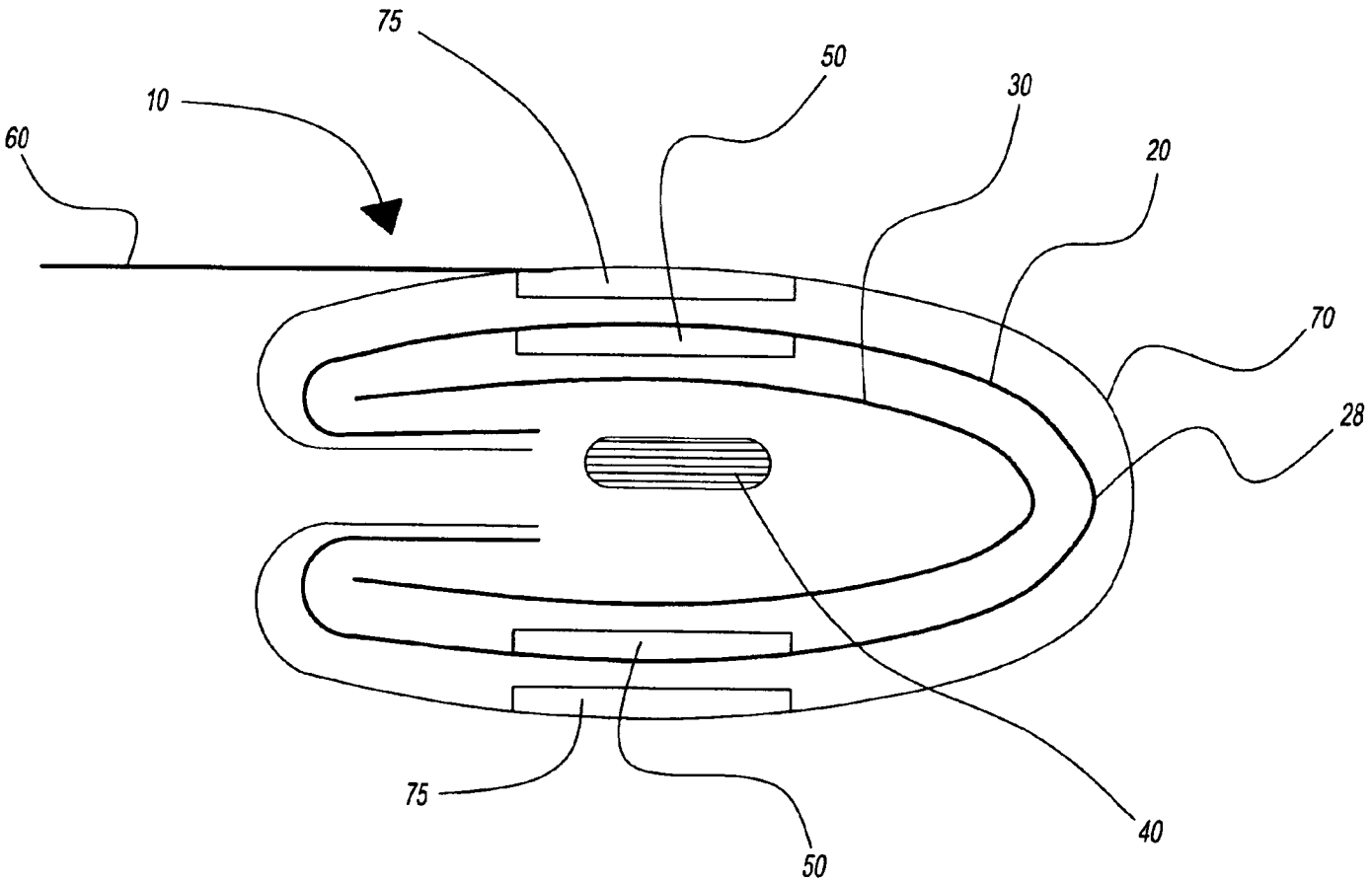
FIG. 4 is a schematic drawing showing a second alternative to the first embodiment of the present invention.

Referring to FIG. 4, body fabric 60 may be connected to second outer material layer 70 at an upper edge of underwire structure 10. This type of underwire casing is sealed using double needle stitching.

Figure 5:
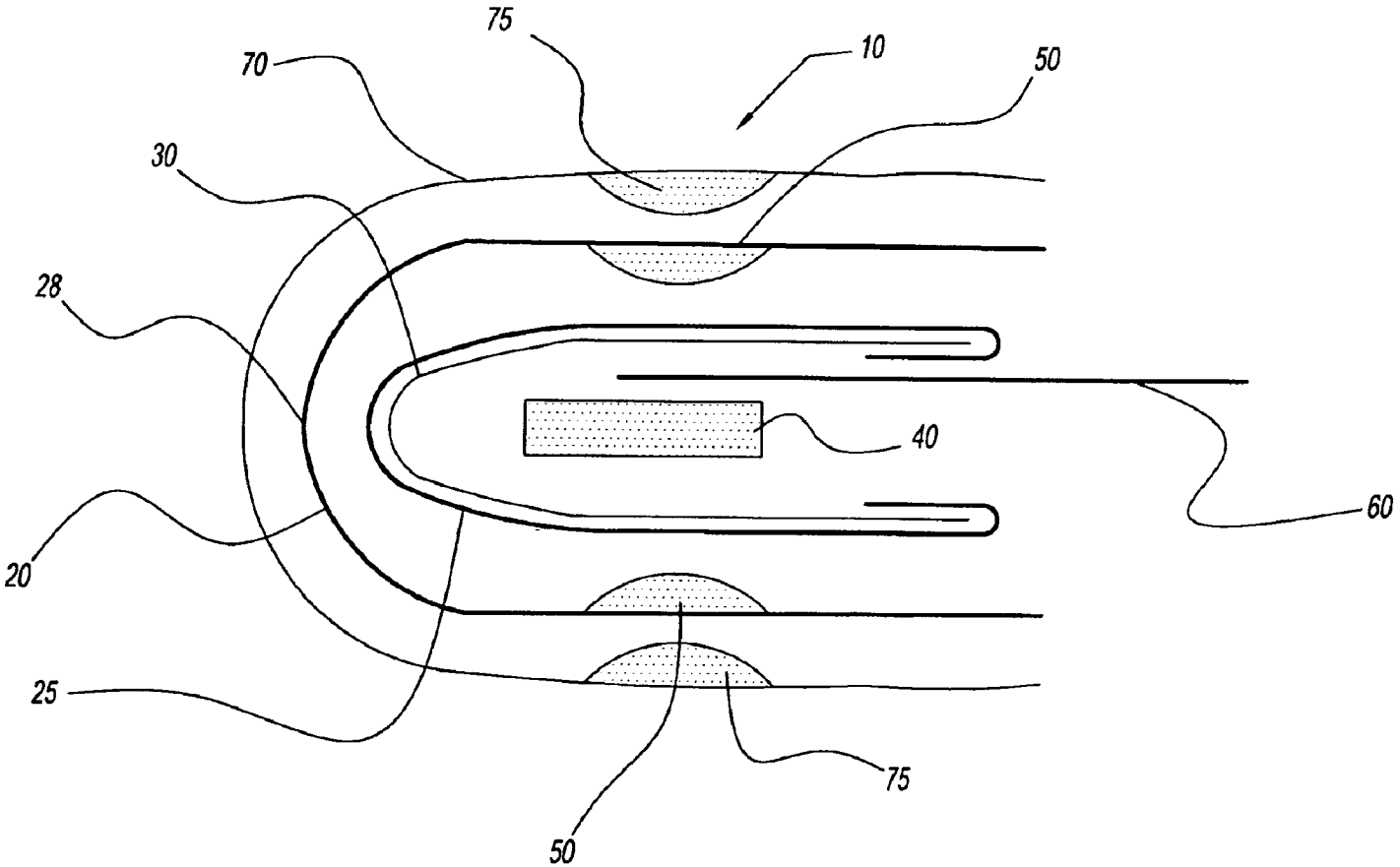
FIG. 5 is a schematic drawing showing a second embodiment of the present invention.

In a second embodiment of the present invention, shown in FIG. 5, underwire structure 10 has at least four layers of material, second outer material layer 70, first outer material layer 20, an inner material layer 30 and an intermediate material layer 25 positioned between first outer material layer 20 and inner material layer 30, and an underwire 40 positioned on inner material layer 30 opposite intermediate material layer 25. Gelatinous material 50 is placed on an interior surface of first outer material layer 20. Gelatinous material 75 is placed on an interior surface of second outer material layer 70. Second outer material layer 70 forms an outside covering around gelatinous material 75, first outer material layer 20, gelatinous material 50, intermediate layer 25, inner material layer 30 and underwire 40.

Inner material layer 30 is positioned on underwire 40 to form an inside covering for the underwire. The function of inner material layer 30 is to prevent underwire 40 from poking through the other layers of material.

Intermediate material layer 25 is positioned between outer material layer 20 and inner material layer 30 to form a second interior covering for underwire 40. Body fabric 60 is preferably positioned on one side of underwire 40 opposite inner material layer 30. The positioning of body fabric 60 in FIG. 5 is analogous to the positioning shown in FIG. 1 in that a portion of the body fabric is in the same plane as underwire 40.

Second outer material layer 70 and first outer material layer 20 are folded about fold line 28 to enclose inner material layer 30 and intermediate material layer 25 about the end of body fabric 60 and underwire 40 creating a multi-layer underwire channel for housing the underwire. Thus, in this embodiment, a casing for underwire 40 is formed by second outer material layer 70, gelatinous material 75, first outer material layer 20, gelatinous material 50, intermediate material layer 25 and inner material layer 30. In this embodiment, stitching, preferably, single needle stitching, is used to seal the casing.

Figure 6:
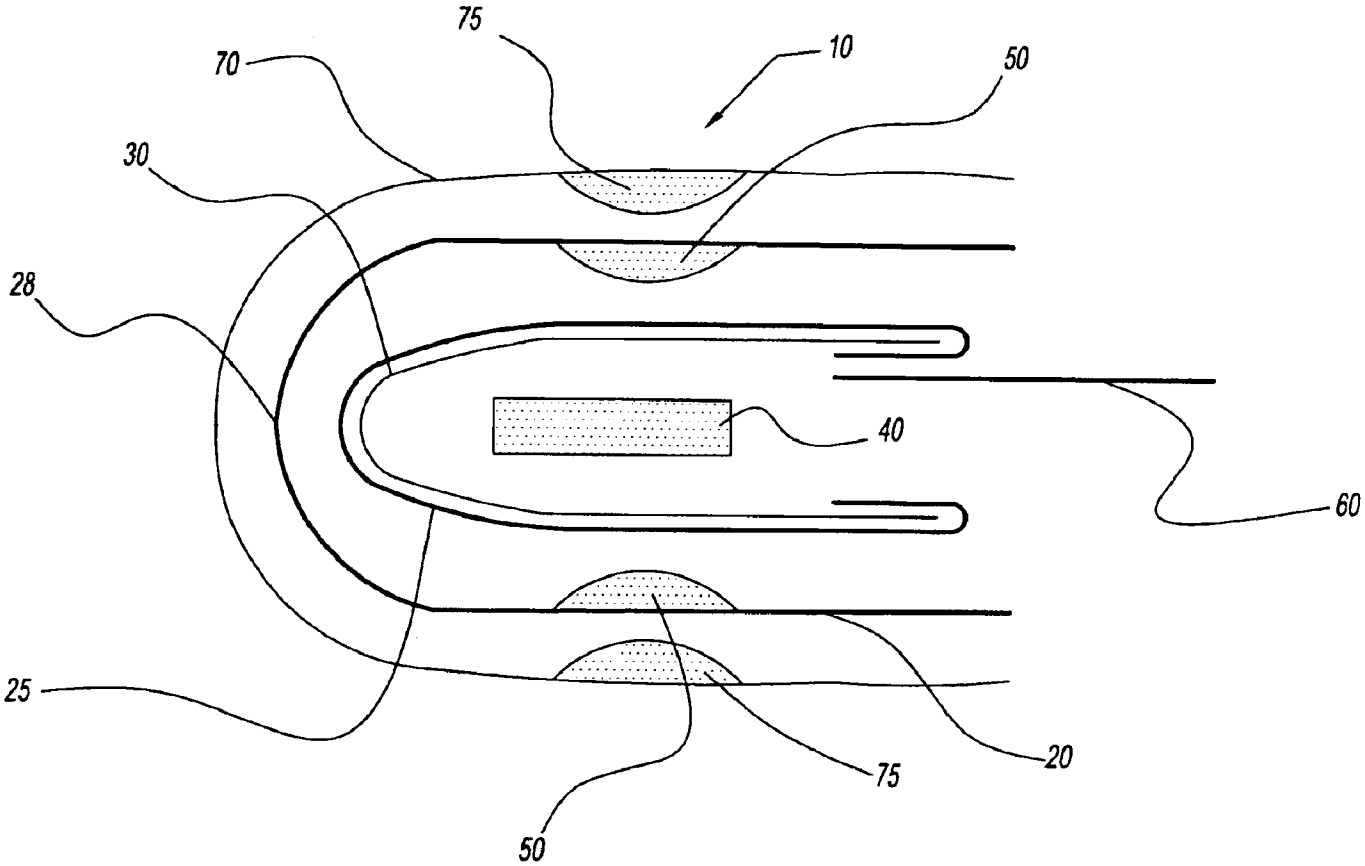
FIG. 6 is a schematic drawing showing an alternative to the second embodiment of the present invention.

As discussed with reference to FIGS. 3 and 4, body fabric 60 may be positioned in alternative locations in relation to underwire structure 10. As shown in FIG. 6, body fabric 60 is positioned such that it is not in the same plane as underwire 40. Instead, when second outer material layer 70 and first outer material layer 20 are folded, body fabric 60 is sandwiched directly between the ends of intermediate fabric layer 25. In another alternative, body fabric 60 is connected to second outer material layer 70 at an upper edge of underwire structure 10. As in FIG. 4, this type of casing is sealed utilizing stitching, preferably double needle stitching.

Second outer material layer 70 and first outer material layer 20 are preferably made of a stretchable material. More preferably, second outer material layer 70 and first outer material layer 20 are made of a three bar powernet knit. Second outer material layer 70 and first outer material layer 20 may be made of varying combinations of nylon and spandex. The percentage of nylon ranges from about 78% to about 84% based on fabric content, while the percentage of spandex ranges from about 16% to about 22% based on fabric content. Preferably, second outer material layer 70 and first outer material layer 20 are made of about 81% nylon and about 19% spandex. Second outer material layer 70 and first outer material layer 20 are lightweight, ranging from about 5 ounces per yard squared (oz/yd$^2$) to about 5.8 oz/yd$^2$. The tensile length of second outer material layer 70 and first outer material layer 20 is minimally about 25 pounds (lbs.), while the tensile width of second outer material layer 70 and first outer material layer 20 is minimally about 33 lbs.

Gelatinous material 75 and 50 is preferably silicone. However, any liquid material can be used that is safe for contact with a wearer and has a soft feel. Gelatinous material 75 and 50 is applied on second outer layer 70 and first outer material layer 20 in strips or tracks. Preferably, gelatinous material 75 is about 56% of the overall weight of the combination of outer material layer 70 and gelatinous material 75. Preferably, gelatinous material 50 is about 56% of the overall weight of the combination of outer material layer 20 and gelatinous material 50. The height or thickness of the strips of gelatinous material 75 and 50 ranges from about 0.02 inches to about 0.03 inches. The width of these strips ranges from about 3/16 inches to about 1/4 inches. The width between the strips ranges from about 1/16 inches to about 1/8 inches. The width of sew region 24 ranges from about 1/8 inches to about 3/16 inches.

Inner material layer 30 is preferably made of a non-woven, non-stretchable fabric material. However, inner material layer 30 may be made of a stretchable material. Inner material layer 30 is preferably made of polyester. More preferably, inner material layer 30 is made of 100% polyester. Inner material layer 30 is lightweight, preferably about 5 oz./yd$^2$+/−10%. The burst strength of inner material layer 30 is minimally about 110 lb. per square inch. The tensile strength of inner material layer 30 is minimally about 55 lbs. The preferred thickness of inner material layer 30 falls in the range of about 0.53 mm to about 0.84 mm. Inner material layer 30 is sold commercially under the name TIETEX® by Tietex International Ltd.

Intermediate material layer 25 is a preferably a woven, non-stretchable material. However, intermediate material layer 25 may be made of a stretchable material. More preferably, intermediate material layer 25 is a nylon taffeta. Intermediate material layer 25 is also lightweight, ranging from about 1.8 oz/yd$^2$ to about 2.2 oz/yd$^2$. The tensile length of intermediate material layer 25 is minimally about 70 lbs., while the tensile width of intermediate material layer is minimally about 60 lbs.

It should be understood that these dimensions may vary depending upon the desired criteria for each group of potential customers.

In either embodiment, an important aspect of the present invention is that the casing of the underwire preferably be stretchable. However, it may be non-stretchable.

Figure 7:
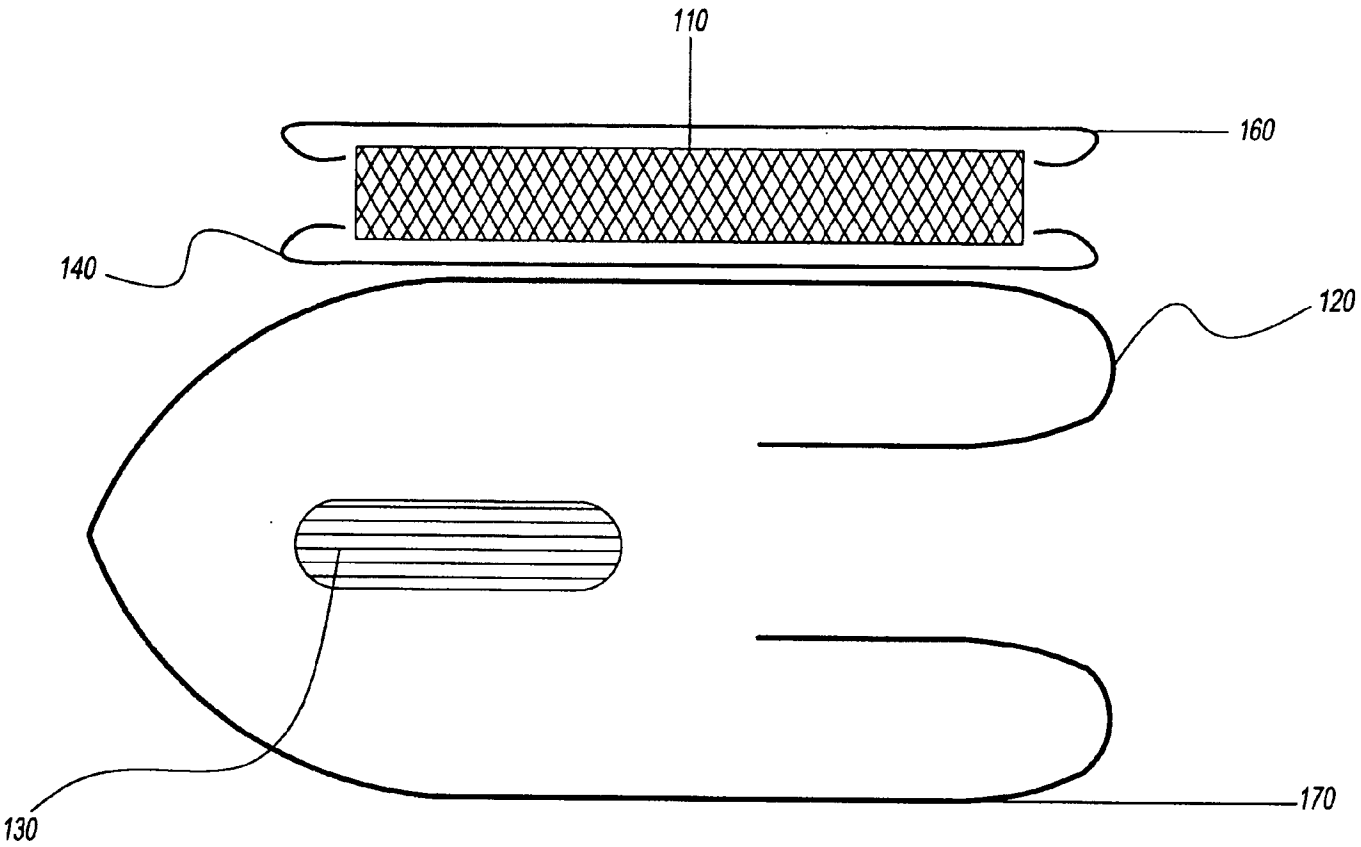
FIG. 7 is a schematic drawing showing a third embodiment of the present invention.

Referring to FIG. 7, there is provided a third embodiment of the underwire structure of the present invention generally represented by reference numeral 100. Underwire structure 100 includes a two ply structure that has a bladder 110 having a gelatinous material placed in or on a layer of a first fabric 140. The gelatinous material is preferably silicone, but may be any type of liquid material that is safe for contact with a wearer and has a soft feel. This structure is placed on a layer of a second fabric 120, and an underwire 130. In this embodiment, only second fabric layer 120 is wrapped around underwire 130. First fabric layer 140 with bladder 110 is positioned on the second fabric layer 120/underwire 130 structure with bladder 110 positioned against a body fabric 160 and opposite a garment or outer brassiere layer 170. In this embodiment, double needle stitching is preferably used to seal the casing. First fabric layer 140 is a rigid fabric, such as a tricot or warp knit fabric, which does not stretch.

Significantly, the bladder configuration can fit a number of different underwire sizes. Preferably, one bladder will fit at least three sizes of underwires.

In all embodiments of the present invention, each end of the underwire optionally may have a protective tip positioned thereon. In addition, the wire casing or channel must have enough room at its ends to avoid poke-through of the underwire.

The present invention provides underwire structures that have the underwire encased by a gelatinous material. These structures provide a cushiony feel, yet are not thick or bulky. Moreover, the cushiony feel is so pronounced that there is a loft created so that the wearer has a softness and pliability, yet the desired support under the breast area.

The present invention having been described with particular reference to the preferred forms thereof, it will be obvious that various changes and modifications may be made without departing from the spirit and scope of the invention as defined herein.

What is claimed is:

1. A cushioning structure for an underwire of a brassiere, comprising:

a first outer layer of fabric disposed about at least a portion of said underwire;

a first gelatinous material between said first outer layer and said underwire;

a second outer layer of fabric disposed about at least a portion of said first outer layer of fabric; and a second gelatinous material between said first outer layer of fabric and said second outer layer of fabric.

2. The cushioning structure of claim 1, further comprising an inner layer of fabric between said first gelatinous material and said underwire.

3. The cushioning structure of claim 2, wherein said first outer layer and said second outer layer of fabric are made of a non-woven, non-stretchable material.

4. The cushioning structure of claim 2, further comprising a fourth layer of fabric between said first gelatinous material and said inner layer of fabric.

5. The cushioning structure of claim 4, wherein said fourth layer is a woven, non-stretchable material.

6. The cushioning structure of claim 1, wherein said second outer layer and said first outer layer are folded to enclose said first and second gelatinous material and said underwire.

7. The cushioning structure of claim 1, wherein one of said first and second gelatinous materials is silicone.

8. The cushioning structure of claim 1, wherein said underwire has a first end and a second end, and wherein each of said first and second ends has a protective tip positioned thereupon.

9. The cushioning structure of claim 2, wherein said inner layer is made of a stretchable material.

10. The cushioning structure of claim 2, wherein said inner layer is made of a three bar powernet knit.

11. The cushioning structure of claim 2, wherein said inner layer is made of a combination of nylon and spandex.

12. The cushioning structure of claim 2, wherein said inner layer is about 78% to about 84% nylon.

13. The cushioning structure of claim 2, said inner layer is about 16% to about 22%.

14. The cushioning structure of claim 2, wherein said inner layer is about 81% nylon and 19% spandex.

15. The cushioning structure of claim 2, wherein said first outer layer and second outer layer are made of polyester.

16. The cushioning structure of claim 2, wherein said first outer layer and second outer layer are made of 100% polyester.

17. The cushioning structure of claim 4, wherein said fourth layer is made of nylon taffeta.

18. A cushioning structure for an underwire of a brassiere, comprising a composite structure having at least two layers of fabric and at least two layers of a gelatinous material, said composite structure having an overall weight, wherein said at least two layers of gelatinous material has a weight of about 56% of said overall weight.

19. A method of forming a cushioning structure comprising the steps of:

applying a first gelatinous material to a side of a first layer of material;

applying a second gelatinous material to a side of a second layer of material;

positioning said second layer outer of material with said second gelatinous material on said first outer layer of material with said first gelatinous material;

positioning an inner layer of material on said first gelatinous material opposite said first layer of material;

positioning an underwire upon said inner layer opposite said gelatinous material;

folding said second outer layer and said first outer layer about a fold line to enclose said second gelatinous material, said first gelatinous material, said inner layer of material and said underwire thereby forming a casing; and sealing said casing along an upper edge of said second outer layer of material opposite said fold line.

* * * * *